US006354958B1

(12) United States Patent
Meyer

(10) Patent No.: US 6,354,958 B1
(45) Date of Patent: Mar. 12, 2002

(54) VIBRATION DAMPER FOR A GOLF CLUB

(76) Inventor: David Meyer, 6453 San Bonita, Clayton, MO (US) 63105

( * ) Notice: Subject to any disclaimer, the term of this patent is extended or adjusted under 35 U.S.C. 154(b) by 0 days.

(21) Appl. No.: 09/547,592

(22) Filed: Apr. 11, 2000

(51) Int. Cl.[7] ..... A63B 53/00
(52) U.S. Cl. ..... 473/297; 473/318
(58) Field of Search ..... 473/282–286, 473/297–300, 303, 201, 206, 223, 257, 568, 523, 549, 318

(56) References Cited

U.S. PATENT DOCUMENTS

| | | | | |
|---|---|---|---|---|
| 1,831,255 | A | | 11/1931 | Menzies |
| 2,023,131 | A | | 12/1935 | Gibson |
| 2,782,035 | A | * | 2/1957 | East |
| 2,991,080 | A | | 7/1961 | Redmond |
| 2,992,828 | A | | 7/1961 | Stewart |
| 4,432,552 | A | | 2/1984 | Saverino |
| 4,858,925 | A | * | 8/1989 | DeStefano |
| 5,330,193 | A | | 7/1994 | Ijiri |
| 5,362,046 | A | | 11/1994 | Sims |
| 5,478,075 | A | | 12/1995 | Saia et al. |
| 5,540,625 | A | | 7/1996 | Koch et al. |
| 5,607,362 | A | | 3/1997 | Haber et al. |
| 5,653,643 | A | | 8/1997 | Falone et al. |
| 5,759,111 | A | * | 6/1998 | Clark |
| 5,792,007 | A | * | 8/1998 | Billings |
| 5,842,933 | A | | 12/1998 | Lewis |
| 6,159,107 | A | * | 12/2000 | Walton |

* cited by examiner

*Primary Examiner*—Stephen Blau
(74) *Attorney, Agent, or Firm*—Senniger, Powers, Leavitt & Roedel

(57) ABSTRACT

A vibration damper for use with a golf club having a shaft having a grip at a first end for gripping the club and a head at a second end for striking a golf ball. The grip is constructed of an elastomeric material and includes a tubular shell having a hollow interior and a cap at one end. The cap has an opening therethrough extending into the hollow interior. The vibration damper comprises an elongate element and a tuned mass. The elongate element is sized and shaped for insertion through the opening of the grip such that a first end of the element is disposed inside the hollow interior of the grip. A second end of the element opposite the first end is adjacent to and mounted on the cap of the grip. The tuned mass mounts on the first end of the element such that the mass is freely suspended within the hollow interior of the grip when the elongate element is inserted through the opening of the grip. When the golf club strikes a golf ball, the resulting vibration of the club is transferred, via engagement of the damper and the grip, to the elongate element and tuned mass. The vibration of the damper reduces the vibration of the club, decreasing uncomfortable vibrations felt by the golfer.

17 Claims, 4 Drawing Sheets

A – UNDAMPED
B – DAMPER WITH 1.0 INCH ELEMENT
C – DAMPER WITH 0.9 INCH ELEMENT

VIBRATION DAMPER FOR A GOLF CLUB

BACKGROUND OF THE INVENTION

This invention generally relates to golf clubs and more particularly to a golf club having vibration dampening features.

Golf clubs typically have a grip on one end of a long, narrow shaft and a club head on the other end of the shaft. When the club head strikes a golf ball, kinetic energy transfers from the golf club to the golf ball. The energy transfer propels the golf ball away from the golfer in a direction roughly parallel to the path of the club head at impact.

Golf clubs have a sweet spot on the club head surface. Striking the golf ball with the sweet spot of the club head typically feels best to the golfer and produces the best energy transfer from the golf club to the golf ball. Moreover, striking the golf ball with the sweet spot transfers only small vibrations to the club. Most golfers do not possess the skill required to hit a golf ball with the sweet spot during every swing. Striking the ball outside the sweet spot or missing the ball and striking the ground or a foreign object, causes a noticeable increase in the vibrational response of the golf club. Added vibration can be annoying and uncomfortable for the golfer. Moreover, reducing the vibration may reduce the likelihood of injury to the golfer, for example as from tendinitis. Golf club designers typically measure these vibrations when designing new golf clubs to better understand the response characteristics of the club. These vibrational frequency measurement techniques are well known by those skilled in the art, as exemplified by U.S. Pat. Nos. 5,616,832 (Nauck) and 5,703,294 (McConnell et al.).

Golf club designers have attempted to dampen these unwanted vibrations in golf clubs. For example, one design incorporates a collapsible shaft that retracts a short distance into the grip when the club strikes an immovable object, such as the ground. Shaft movement into the grip allegedly reduces the induced vibration. Another design incorporates vibration absorbing materials, such as elastomers, inside the grip or shaft or as a club head coating. These elastomeric materials allegedly dampen unwanted vibrations. A third design incorporates an elastomeric vibration damping device mounted on the grip of the golf club. This design extends outward from the shaft, rather than inward, and is not compatible with an existing golf club grip. Moreover, the reduced density of the elastomeric material limits its ability to dampen vibrations.

Each of these devices is designed to be incorporated into a new golf club, rather than as an addition to a conventional club. Accordingly, there is a need for a vibration damper adapted for use with existing golf clubs. Such a vibration damper would be useful, because adding a low-cost vibration dampening device to existing golf clubs would be beneficial.

Moreover, current designs do not account for differences in vibrational response, which depend on the club geometry. Thus, there is a need for a vibration damper that reduces vibrational response in different golf clubs.

SUMMARY OF THE INVENTION

Among the several objects and features of the present invention may be noted the provision of a vibration damper which attaches to an existing golf club for reducing the vibration felt by the golfer; the provision of such a vibration damper which does not negatively affect golf club feel; and the provision of such a vibration damper which installs without tools and retains itself within the golf club without fasteners.

Briefly, apparatus of this invention is a vibration damper for a golf club. The golf club includes a shaft having a grip at a first end for gripping the club and a head at a second end opposite the first end for striking a golf ball. The grip is constructed of an elastomeric material and includes a tubular shell with a hollow interior sized for receiving the first end of the shaft. A cap at one end of the grip has an opening therethrough extending into the hollow interior of the shell. The vibration damper comprises an elongate element sized and shaped for insertion through the opening of the grip so a first end of the element is disposed inside the hollow interior of the grip and a second end of the element, opposite the first end, is positioned adjacent the cap. A tuned mass is mounted on the first end of the element such that the mass is freely suspended within the hollow interior of the grip when the elongate element is inserted through the opening of the grip. When the golf club strikes a golf ball, the resulting vibration of the club is transferred to the elongate element and the tuned mass such that the vibration of the damper reduces the vibration of the club, decreasing uncomfortable vibrations felt by the golfer. Tuning the tuned mass and vibration damper for a specific golf club is discussed infra.

In another aspect, apparatus of the present invention includes a golf club comprising a vibration damper generally as set forth above.

In yet another aspect, apparatus of the present invention includes a golf club grip comprising a vibration damper generally as set forth above.

Other objects and features will be in part apparent and in part pointed out hereinafter.

BRIEF DESCRIPTION OF THE DRAWINGS

Corresponding reference characters indicate corresponding parts throughout several views of the drawings.

DETAILED DESCRIPTION OF THE PREFERRED EMBODIMENTS

Figure 1:
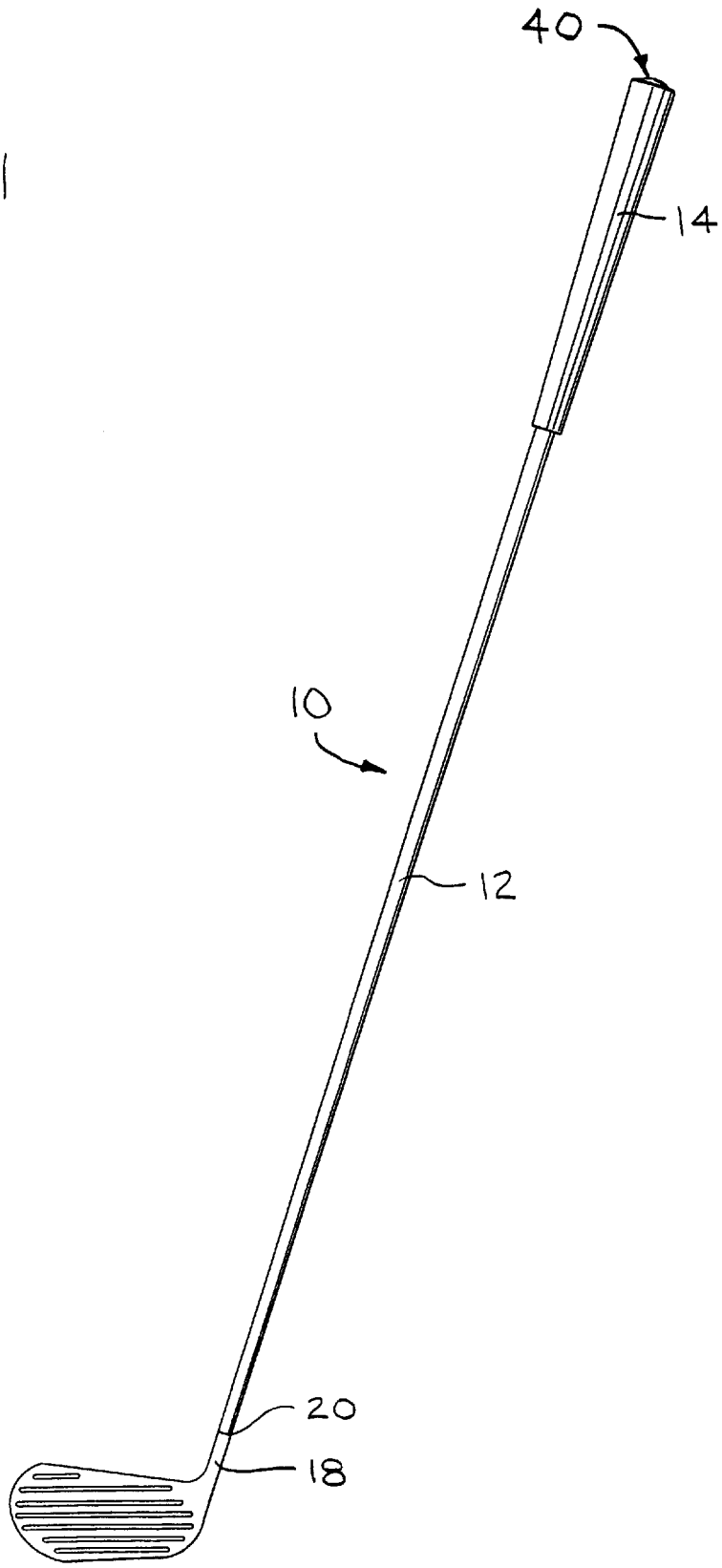
FIG. 1 is side elevation of a golf club having a vibration damper.
Figure 2:
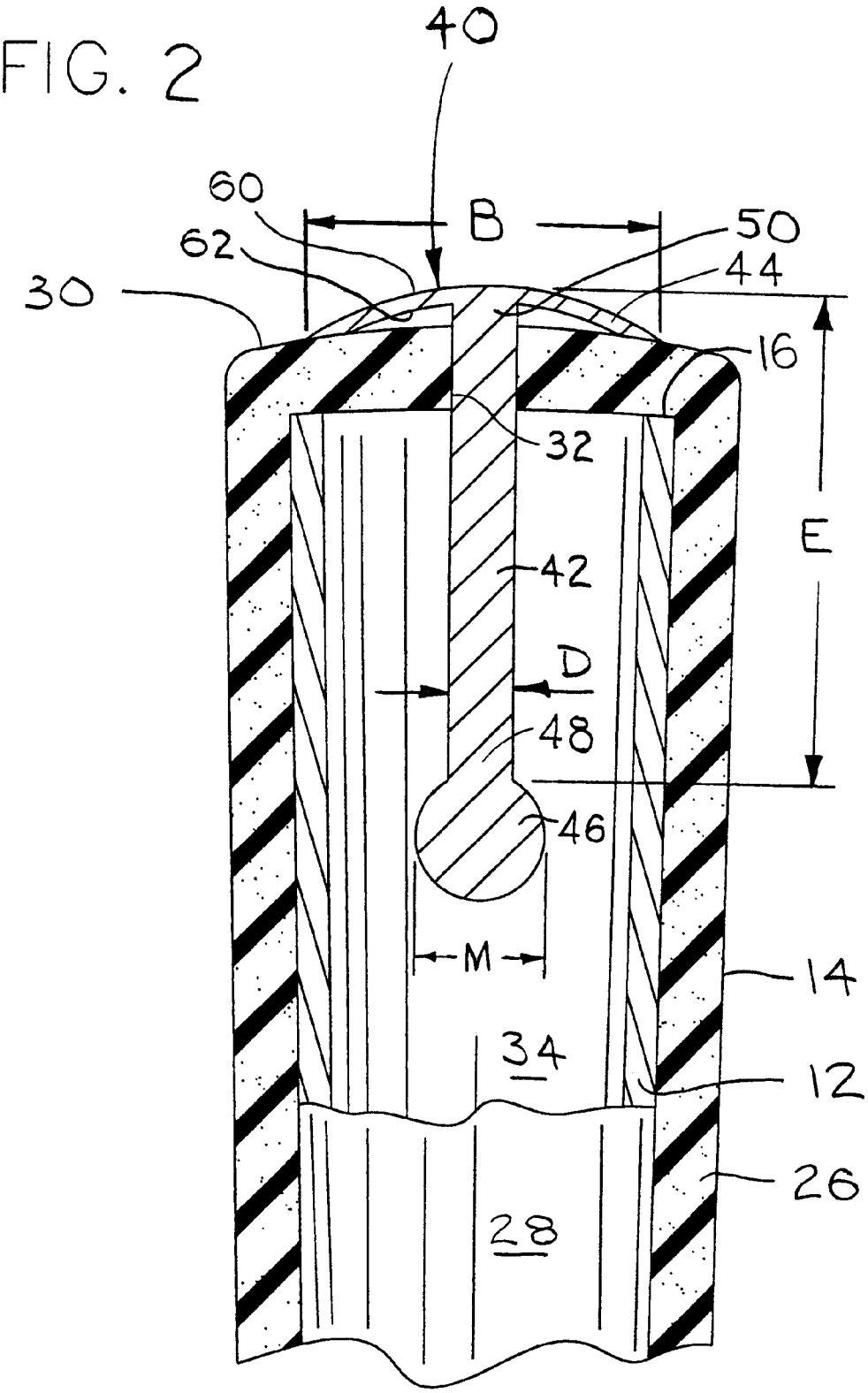
FIG. 2 is an enlarged, fragmentary section of the golf club of FIG. 1.

Referring now to the drawings and specifically to FIG. 1, a golf club of the present invention is generally indicated by the reference character 10. The golf club 10 includes a hollow shaft 12 having a grip 14 at a first end 16 (FIG. 2) for gripping the club and a head 18 at a second end 20 opposite the first end for striking a golf ball (not shown). Club manufacturers typically form the shaft 12 from a hard, but flexible material such as steel or a carbon-fiber composite. As illustrated in FIG. 2, the grip 14, which is typically constructed of a material such as leather or rubber, has a tubular shell 26 with a hollow interior 28. A cap 30 closes one end of the grip 14. The cap 30 is frequently constructed of the same material as the grip 14 and has a central opening 32, which aids in installing the grip on the shaft 12. Once the grip 14 is installed on the shaft 12, the opening 32 extends through the cap 30 to a hollow interior 34 of the shaft. The grip 14 slips over the first end 16 of the shaft 12 of the golf club 10 and along the shaft until the cap 30 of the grip rests against the shaft end 16 of the shaft.

As further illustrated in FIG. 2, a vibration damper of the present invention, generally indicated at 40, mounts on the cap 30. The damper 40 generally includes an elongate element 42, a base 44, and a tuned mass 46. Although the damper of the preferred embodiment has a unitary construction, it is envisioned the element 42, base 44, and mass 46 may be assembled from two or more parts without departing from the scope of the present invention. Although the elongate element 42 of the preferred embodiment is cylindrical, other shapes, such as those with square cross sections or cross sections varying along the length of the element, are also envisioned as being within the scope of this invention. The tuned mass 46 is formed on a first end 48 of the elongate element 42. Although the tuned mass 46 of the preferred embodiment is spherical, other shapes are contemplated as being within the scope of this invention. The preferred tuned mass diameter M is approximately 0.3 inches. Further, although the tuned mass diameter M of the preferred embodiment is sized to be press fit through the opening 32 in the grip 14, other sizes are contemplated as being within the scope of the present invention. For instance, M may vary from 0.25 inches to 0.315 inches and be readily applicable to the preferred grip. Still, wider variation in opening 32 size and grip 14 size may require further deviation from the preferred M dimension.

Figure 3:
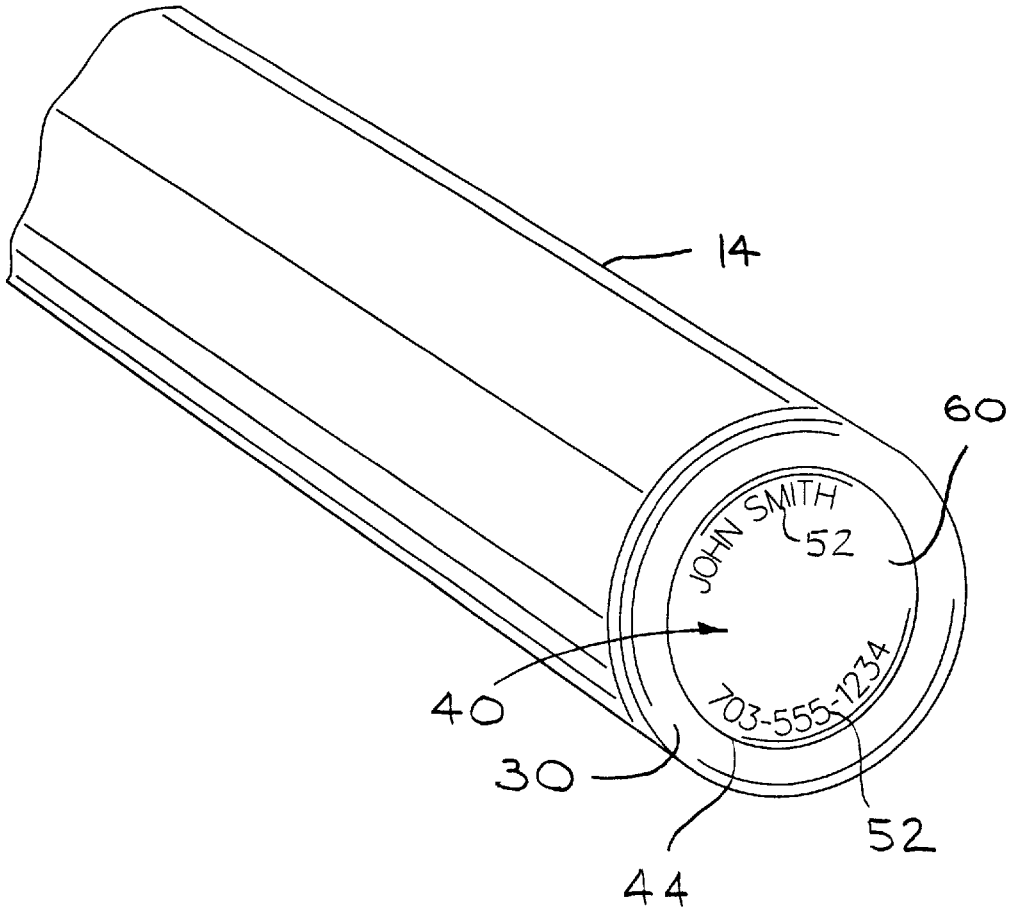
FIG. 3 is a fragmentary perspective of the golf club and damper showing indicia on the damper.

The base 44 of the damper 40 is formed on a second end 50 of the elongate element 42. In the preferred embodiment, the base 44 is dish-shaped, having opposite convex 60 and concave 62 sides. The concave side 62 of the base 44 faces the elongate element 42. It is envisioned that the convex side 60 may have indicia 64 such as a trademark of the manufacturer or a name and phone number of the club owner (FIG. 3).

The elongate element 42 of the vibration damper 40 is sized for insertion through the opening 32 in the grip 14 (FIG. 2). Although the elongate element 42 may have other diameters D without departing from the scope of the present invention, in the preferred embodiment the element has a diameter of about 0.155 inches. For instance, the diameter D may readily fall within a range from about 0.125 inches to about 0.155 inches. The first end 48 of the vibrational damper 40 is inserted through the opening 32, such that the tuned mass 46 and most of the elongate element 42 are disposed within the hollow interior 34 of the shaft 12 while the second end 50 of the element 42 is adjacent the cap 30, outside the grip 14. Further, the tuned mass 46 is freely suspended within the shaft 12. The base 44 is larger than the opening 32 in the grip 14 so the outer edge of the concave side 62 of the base 44 rests on the cap 30 of the grip. In the preferred embodiment, the base B has a diameter of about 0.75 inches, but may vary between about 0.75 inches and about 0.875 inches. Other suitable base diameters B are contemplated as within the scope of the invention. The friction fit between the elongate element 42 and the opening 32 in the grip 14 holds the damper 40 in place. Not only is the vibration damper 40 designed for insertion in the grip 14 of an existing club 10, but also club makers may install the vibration damper into a new golf club. The damper 10 may also be integrally formed with the grip (not shown).

Applying vibration damper principles to a golf club can create a more pleasing feeling for a golfer. The elongate element 42 and tuned mass 46 of the damper 40 are sized, arranged, and formed from specific materials to dampen vibrations of a particular golf club 10. This process tunes the vibration damper to a specific club. To select a damper 40 configuration, a designer chooses a damper that has a natural vibrational frequency equal to a natural vibrational frequency of the golf club 10. Varying the length, diameter, mass, and shape of the elongate element 42 can influence the natural frequency of the vibration damper 40, thereby tuning the damper to a specific club. In the preferred embodiment, the elongate element 42 has a preferred length E of between 0.5 inches and 1.0 inches, although different lengths are contemplated as within the scope of the invention. Moreover, varying the diameter, mass, and shape of the tuned mass 46 can change the natural frequency of the damper 40, further tuning the damper. Finally, altering the damper material can change the density and modulus of elasticity of the damper 40, which alters the natural frequency of vibration. In the preferred embodiment, the damper is preferably formed from yellow brass (i.e., alloy C27000) having a nominal composition of 65.0% copper and 35.0% zinc. Yellow brass has a density of approximately 0.306 pounds per cubic inch and a modulus of elasticity of between about 14,000,000 pounds per square inch and about 17,000,000 pounds per square inch. By varying the foregoing parameters, the vibrational characteristics of the damper 40 may be tuned to match a specific golf club 10 and to reduce harsh vibrations within the club more quickly than without the damper. Reducing vibration creates a more pleasant feel for the golfer.

In experiments conducted with the damper of the present invention, the presence of the vibration damper increased the rate of vibrational decay within the golf club as compared with the same golf club without a vibration damping device. Because the vibrations decay more quickly, the golfer feels fewer severe vibrations, improving the feel of the club. To measure the vibrational decay of the golf club, an accelerometer attached to the club provided a signal to an amplifier, which processed the signal for analysis. The club was subjected to discrete impacts with several different dampers installed and without a vibration damper installed. A data management program collected the data and processed it to find the rate of vibrational decay of the golf club. The rate of decay of the different club and damper combinations were compared. As will be appreciated by those skilled in the art, the club with more rapid vibrational decay produces a better feel for the golfer.

Figure 4:
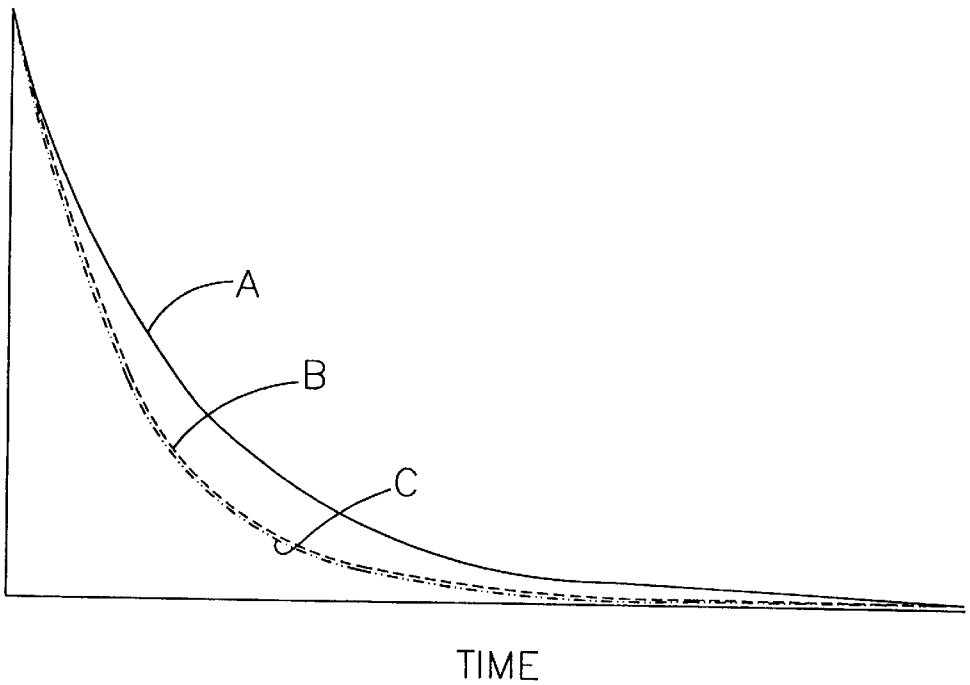
FIG. 4 is a graph showing the vibration damping effect of the vibration damper.

Referring now to FIG. 4, a graph may be made showing the vibrational decay for different club and damper combinations. The y-axis of the graph represents the amplitude of the vibration while the x-axis represents elapsed time after the initial impact. In all three cases, club vibrations dissipate over time. Curve A (Undamped) represents the vibrational decay of a golf club without benefit of the vibration damper. Vibrations in the undamped golf club decayed the slowest of the three curves, as shown by a more gradual slope change in the curve. Without the benefit of a vibration damper, the club continues to vibrate with a greater amplitude for a longer time. In contrast, curves B and C represent the vibrational decay of a golf club with a vibration dampening device. Curve B corresponds to a dampening device having an element which is 1.0 inch long. Curve C corresponds to a dampening device having an element which is 0.9 inch long. The dampers generating curves B and C both had tuned mass diameters M of 0.3 inches, elongate element diameters D of 0.155 inches, and base diameters B of 0.75 inches. Each of these vibration dampers reduces the vibration severity more quickly than the undamped club. This data shows that using the vibrational damper with a golf club reduces unwanted vibration. For the two dampers tested in the experiment, the preferred damper length is approximately 0.9 inches. Additional experimentation with different damper designs could potentially yield a damper/club combination producing faster rates of decay. Golf clubs differing in size, weight, composition, and shape would likely require different vibration dampers to experience similar rates of vibration decay.

Although the vibration damper of the preferred embodiment is designed for use with a golf club, application of the present invention to other striking implements such as tennis rackets and hammers is also envisioned as being within the scope of this invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A vibration damper for a golf club including a shaft having a grip at a first end for gripping the club and a head at a second end opposite said first end for striking a golf ball, the grip being constructed of an elastomeric material and including a tubular shell having a hollow interior sized for receiving said first end of the shaft and a cap at one end having an opening therethrough extending into the hollow interior of the shell, the vibration damper comprising:

an elongate element sized and shaped for insertion through the opening of the grip such that a first end of the element is disposed inside the hollow interior of the grip and a second end of the element opposite said first end is positioned adjacent the cap; and a tuned mass mounted on said first end of the element such that the mass is freely suspended within the hollow interior of the grip when the elongate element is inserted through the opening of the grip, said element and tuned mass being sized and shaped such that the damper has a natural vibrational frequency substantially equal to a natural vibrational frequency of the golf club whereby when a golfer swings the golf club and strikes a golf ball, the resulting vibration of the club is transferred to the elongate element and the tuned mass such that the vibration of the damper reduces the vibration of the club, decreasing uncomfortable vibrations felt by the golfer.

2. A vibration damper as set forth in claim 1 further comprising a base mounted on said second end of the element for attaching the damper to the cap of the grip.

3. A vibration damper as set forth in claim 2 wherein the base is larger than the opening in the grip to prevent the second end of the element from moving through the opening in the grip.

4. A vibration damper as set forth in claim 3 wherein the base is dish-shaped, having a concave side facing the cap of the grip and a convex side opposite the concave side.

5. A vibration damper as set forth in claim 4 wherein the base has a diameter of between about 0.75 inch and about 0.875 inch.

6. A vibration damper as set forth in claim 5 wherein the base has a diameter of about 0.75 inch.

7. A vibration damper as set forth in claim 1 wherein the tuned mass is spherical.

8. A vibration damper as set forth in claim 7 wherein the tuned mass has a diameter of between about 0.25 inch and about 0.315 inch.

9. A vibration damper as set forth in claim 8 wherein the tuned mass has a diameter of about 0.3 inch.

10. A vibration damper as set forth in claim 1 wherein the elongate element has a length of between about 0.5 inch and about 1.0 inch.

11. A vibration damper as set forth in claim 1 wherein the elongate element is generally cylindrical in shape.

12. A vibration damper as set forth in claim 11 wherein the elongate element has a diameter of between about 0.125 inch and about 0.155 inch.

13. A vibration damper as set forth in claim 12 wherein the elongate element has a diameter of about 0.155 inch.

14. A vibration damper as set forth in claim 1 wherein the damper has a modulus of elasticity of between about 14,000,000 pounds per square inch and about 17,000,000 pounds per square inch.

15. A vibration damper as set forth in claim 14 wherein the damper has a modulus of elasticity of about 15,000,000 pounds per square inch.

16. A golf club comprising:

a shaft having a first end and a second end opposite the first end;

a grip for gripping the club mounted at the first end of the club including a tubular shell having a hollow interior sized and shaped for receiving said first end of the club and a cap at one end of the shell;

a head for striking a golf ball mounted at said second end of the club; and a vibration damper having an elongate element extending into the hollow interior of the shell from the cap such that a first end of the element is disposed inside the hollow interior of the grip and a second end of the element opposite said first end is mounted on said cap of the grip, the tuned mass being mounted on said first end of the element such that the mass is freely suspended within the hollow interior of the grip, said element and tuned mass being sized and shaped such that the damper has a natural vibrational frequency substantially equal to a natural vibrational frequency of the golf club whereby when a golfer swings the golf club and strikes a golf ball, the resulting vibration of the club is transferred to the elongate element and tuned mass such that the vibration of the damper reduces the vibration of the club, decreasing uncomfortable vibrations felt by the golfer.

17. A golf club grip for use with a golf club, the grip comprising:

a tubular shell having a hollow interior;

a cap positioned at one end of the tubular shell constructed of an elastomeric material; and a vibration damper having an elongate element mounted on the cap such that a first end of the element is disposed inside the hollow interior of the grip and a second end of the element opposite said first end is mounted on said cap of the grip, and a tuned mass mounted on said first end of the element such that the mass is freely suspended within the hollow interior of the grip, said element and tuned mass of the vibration damper being sized and shaped such that the damper has a natural vibrational frequency substantially equal to a natural vibrational frequency of the golf club whereby when the a golfer swings the golf club and strikes a golf ball, the resulting vibration of the club is transferred to the elongate element and tuned mass such that the vibration of the damper reduces the vibration of the club, decreasing uncomfortable vibrations felt by the golfer.

* * * * *